United States Patent [19]

Horn

[11] Patent Number: 5,064,356

[45] Date of Patent: Nov. 12, 1991

[54] COUNTERWEIGHT SHIELD FOR REFRIGERATION COMPRESSOR

[75] Inventor: James F. Horn, Sidney, Ohio

[73] Assignee: Copeland Corporation, Sidney, Ohio

[21] Appl. No.: 591,442

[22] Filed: Oct. 1, 1990

[51] Int. Cl.[5] ..... F04B 17/00; F03C 2/00

[52] U.S. Cl. ..... 417/410; 417/368; 417/902; 418/88; 418/55.6

[58] Field of Search ..... 417/410, 368, 902; 418/88, 55.6; 184/6.16, 6.18, 11.1, 13.1

[56] References Cited

U.S. PATENT DOCUMENTS

| | | |
|---|---|---|
| 1,797,287 | 3/1931 | Kucher . |
| 2,066,177 | 12/1936 | Johnson . |
| 2,069,767 | 2/1937 | McCormack . |
| 2,178,811 | 11/1939 | Sateren . |
| 2,683,233 | 7/1954 | Ruhl . |
| 2,883,101 | 4/1959 | Kosfeld . |
| 3,147,914 | 9/1964 | Hatten et al. . |
| 3,480,205 | 11/1969 | Hatten . |
| 3,565,553 | 2/1971 | Rinehart et al. . |
| 3,614,384 | 10/1971 | Heitchue, Sr. . |
| 3,664,771 | 5/1972 | Suzuki et al. . |
| 4,127,994 | 12/1978 | Niven . |
| 4,445,056 | 4/1984 | Gaylord . |
| 4,517,479 | 5/1985 | Aleem et al. . |
| 4,545,743 | 10/1985 | Earley . |
| 4,564,339 | 1/1986 | Nakamura et al. . |
| 4,565,503 | 1/1986 | Wise . |
| 4,569,639 | 2/1986 | Hannibal et al. . |
| 4,609,334 | 9/1986 | Muir et al. . |
| 4,621,993 | 11/1986 | Nakamura et al. . |
| 4,730,988 | 3/1988 | Ma . |
| 4,895,496 | 1/1990 | Elson . |
| 4,934,905 | 6/1990 | Richardson, Jr. . |

FOREIGN PATENT DOCUMENTS

| | | |
|---|---|---|
| 60-237182 | 11/1985 | Japan . |
| 62-143081 | 9/1987 | Japan . |

*Primary Examiner*—Richard A. Bertsch
*Assistant Examiner*—Alfred Basichas
*Attorney, Agent, or Firm*—Harness, Dickey & Pierce

[57] ABSTRACT

A refrigeration motor compressor assembly has a housing including a lubricant sump in the bottom thereof into which the lower end of the drive shaft and associated rotor extend. A shield is provided which is supported on and positioned by the drive shaft in underlying spaced relationship to the lower end of the rotor and associated counterweight. As the rotor rotates, lubricant disposed between the shield and rotor therein is thrown outwardly across the end turns of the stator thus serving to cool same. The shield serves to restrict the return flow of oil to the area immediately below the rotor thus reducing the viscous drag on the motor yet still allowing sufficient circulation of oil to achieve the desired cooling of the stator.

15 Claims, 2 Drawing Sheets

COUNTERWEIGHT SHIELD FOR REFRIGERATION COMPRESSOR

BACKGROUND AND SUMMARY OF THE INVENTION

The present invention relates generally to refrigeration compressors and more specifically to such compressors incorporating shields for reducing the lubricating oil level in the area surrounding the rotating rotor during operation.

Typical refrigeration compressors incorporate a lubricant sump in the lower or bottom portion of the housing into which the drive shaft extends so as to pump lubricant therefrom to the various portions requiring lubrication. In addition, the lubricant also often acts to aid in removal of heat from the various components. In order to insure sufficient lubricating oil is contained within the sump to assure adequate lubrication and/or cooling of the moving parts while also minimizing the overall height of the housing, it is sometimes necessary that the oil level extend above the rotating lower end of the rotor. However, the higher viscosity of the oil as compared to refrigerant gas creates an increased drag on rotation of the rotor resulting in increased power consumption. This problem is further aggravated in scroll-type compressors which typically employ a counterweight secured to the lower end of the rotor.

U.S. Pat. No. 4,895,496 discloses a cup-shaped shield member which projects above the oil level in the sump and is positioned in surrounding relationship to the lower end of the rotor via a close fit with the drive shaft whereby the oil level in the area within the shield is reduced by the initial rotation of the rotor upon startup and return oil flow into this area is greatly restricted. Thus, the oil induced drag on the rotor and resulting increased power consumption of the motor is greatly reduced. In one embodiment, a rotation inhibiting projection is provided on the shield while in another embodiment the shield is allowed to rotate with the drive shaft although the speed of rotation thereof will be substantially less than that of the drive shaft due to the drag exerted thereon by the lubricant. In both embodiments, however, the power consumption of the motor is greatly reduced thus resulting in significant improvement in the operating efficiency of the compressor.

While the above described shield does reduce motor power consumption by substantially eliminating the viscous drag of the oil on the rotor, it also reduces the amount of oil being circulated across the lower end turns of the stator. In some applications, it may be desirable to achieve the advantages of this higher operating efficiency while also maintaining a substantial flow of oil across the stator end turns for cooling of same.

The present invention provides an improved shield which is carried by the drive shaft and allowed to freely rotate therewith. This improved shield incorporates a generally flat circular disk or flange positioned in close proximity to the lower end of the rotor which serves to restrict return flow of oil to the area of the rotating rotor and/or counterweight but still enables some circulation thereof which thereby increases the circulation of oil across the adjacent stator end turns. In operation, it has been found that this improved shield has resulted in improved cooling of the stator end turns without any substantial effect on the overall operating efficiency of the compressor.

Additional advantages and features of the present invention will become apparent from the subsequent description and the appended claims taken in conjunction with the accompanying drawings.

DESCRIPTION OF THE PREFERRED EMBODIMENT

Figure 1:
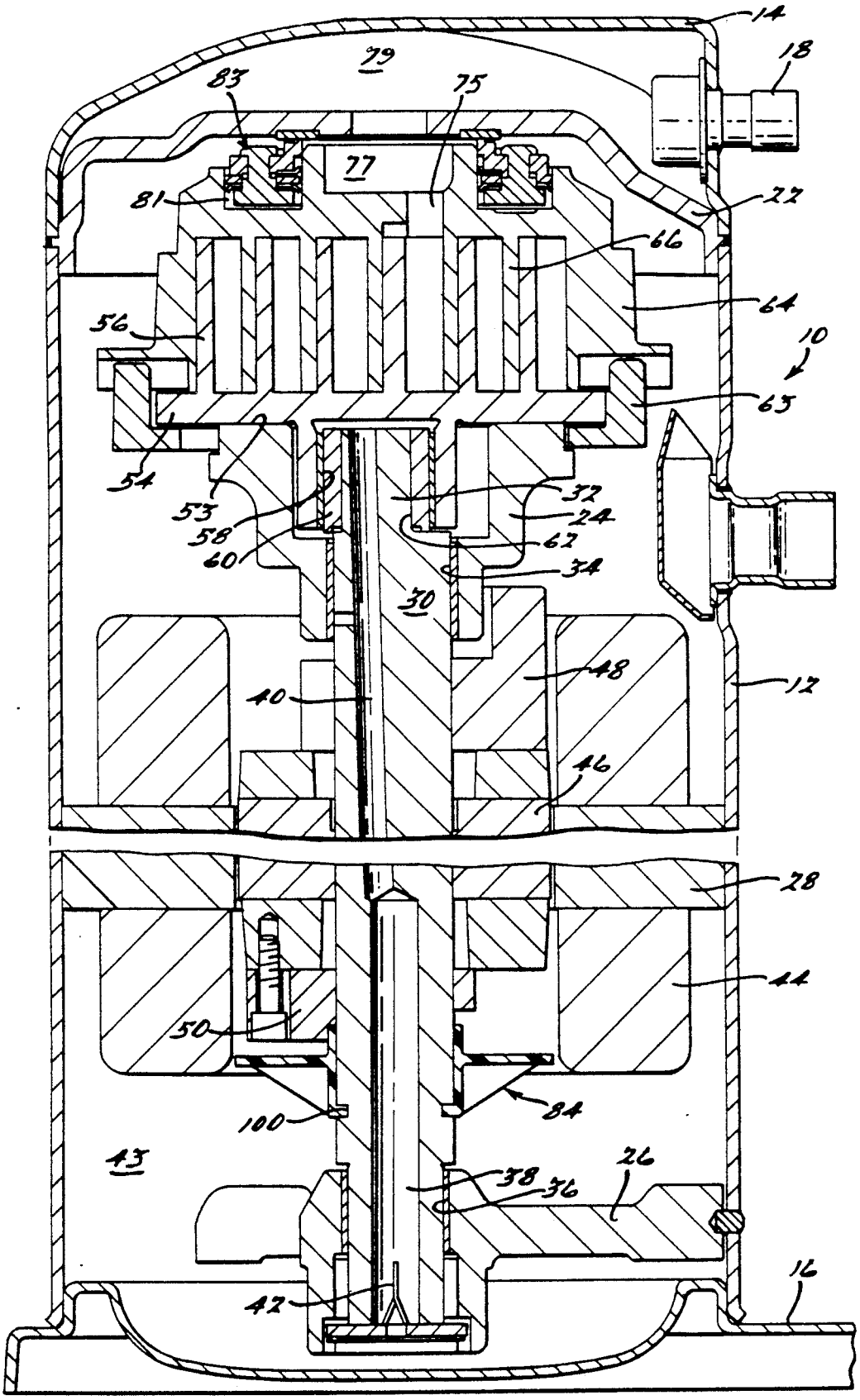
FIG. 1 is a section view of a refrigeration compressor of the scroll type incorporating a shield surrounding the lower end of the motor rotor in accordance with the present invention, the section being taken generally along a vertical plane extending along the axis of rotation of the drive shaft.
Figure 2:
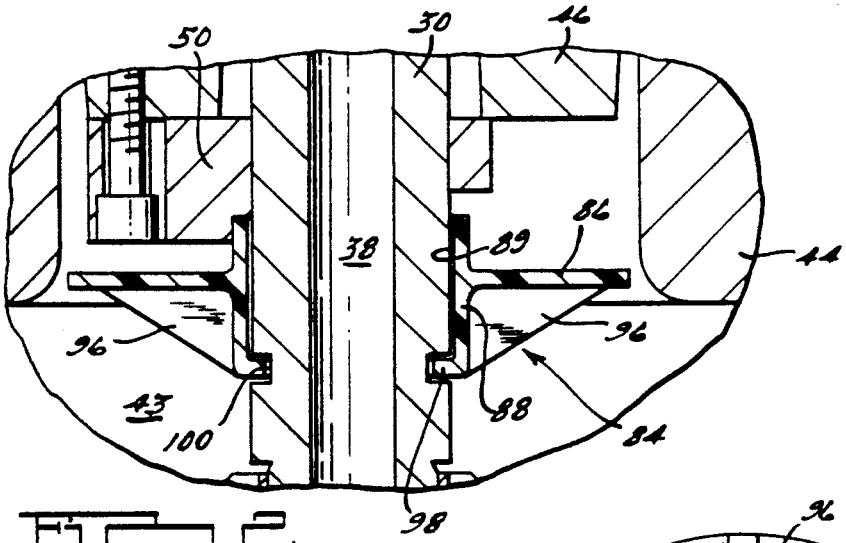
FIG. 2 is an enlarged fragmentary section view of a portion of the compressor of FIG. 1 showing the shield of the present invention in installed relationship with the drive shaft.
Figure 3:
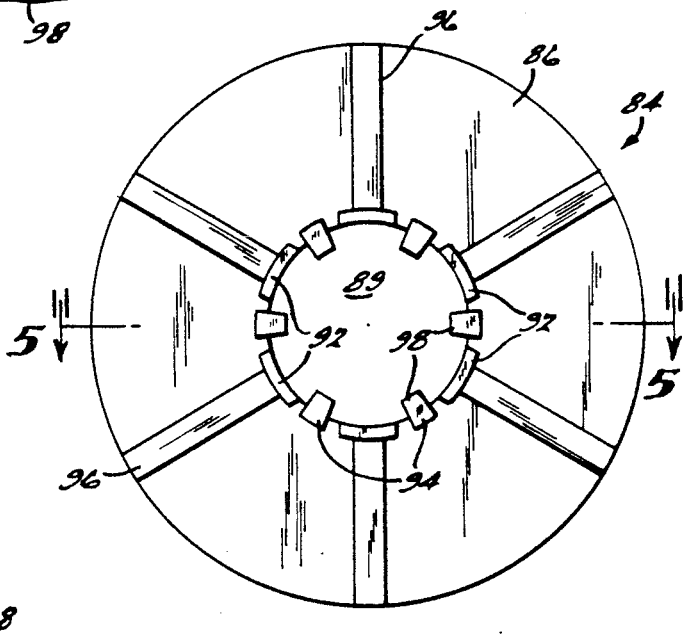
FIG. 3 is a bottom view of the shield of the present invention.
Figure 4:
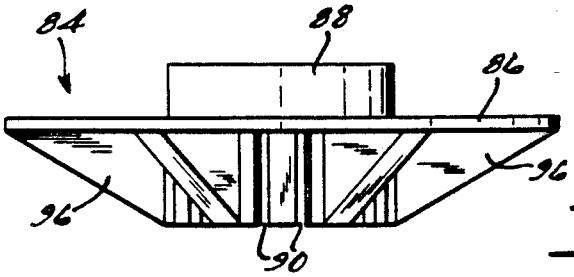
FIG. 4 is an elevational view of the shield of FIG. 3.
Figure 5:
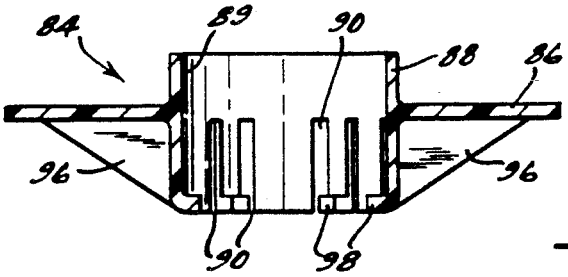
FIG. 5 is a section view of the shield of FIG. 3, the section being taken along line 5—5 thereof.

Referring now to the drawings and in particular to FIG. 1, a compressor 10 is shown which comprises a generally cylindrical hermetic shell 12 having welded at the upper end thereof a cap 14 and at the lower end thereof a base 16 having a plurality mounting feet (not shown) integrally formed therewith. Cap 14 is provided with a refrigerant discharge fitting 18 which may have the usual discharge valve therein (not shown). Other major elements affixed to the shell include a transversely extending partition 22 which is welded about its periphery at the same point that cap 14 is welded to shell 12, a main bearing housing 24 which is suitably secured to shell 12 and a lower bearing housing 26 also having a plurality of radially outwardly extending legs each of which is also suitably secured to shell 12. A motor stator 28 which is generally square in cross section but with the corners rounded off is pressfitted into shell 12. The flats between the rounded corners on the stator provide passageways between the stator and shell, which facilitate the flow of lubricant from the top of the shell to the bottom.

A drive shaft or crankshaft 30 having an eccentric crank pin 32 at the upper end thereof is rotatably journaled in a bearing 34 in main bearing housing 24 and a second bearing 36 in lower bearing housing 26. Crankshaft 30 has at the lower end a relatively large diameter concentric bore 38 which communicates with a radially outwardly inclined smaller diameter bore 40 extending upwardly therefrom to the top of the crankshaft. Disposed within bore 38 is a stirrer 42. The lower portion of the interior shell 12 defines an oil sump 43 which is filled with lubricating oil to a level approximately equal to or slightly above the lower end of rotor 46, and bore 38 acts as a pump to pump lubricating fluid up the crankshaft 30 and into passageway 40 and ultimately to all of the various portions of the compressor which require lubrication.

Crankshaft 30 is rotatively driven by an electric motor including stator 28, windings 44 passing therethrough and a rotor 46 pressfitted on the crankshaft 30 and having upper and lower counterweights 48 and 50, respectively.

The upper surface of main bearing housing 24 is provided with a flat thrust bearing surface 53 on which is disposed an orbiting scroll 54 having the usual spiral vane or wrap 56 on the upper surface thereof. Projecting downwardly from the lower surface of orbiting scroll 54 is a cylindrical hub having a journal bearing 58 therein and in which is rotatively disposed a drive bushing 60 having an inner bore 62 in which crank pin 32 is drivingly disposed. Crank pin 32 has a flat on one surface which drivingly engages a flat surface (not shown) formed in a portion of bore 62 to provide a radially compliant driving arrangement, such as shown in assignee's aforementioned U.S. Pat. No. 4,877,382, the disclosure of which is herein incorporated by reference. An Oldham coupling 63 is also provided positioned between and keyed to orbiting scroll 54 and bearing housing 24 to prevent rotational movement of orbiting scroll member 54. Oldham coupling 63 is preferably of the type disclosed in assignee's copending application Ser. No. 591,443, entitled "Oldham Coupling For Scroll Compressor" filed of even data herewith, the disclosure of which is hereby incorporated by reference.

A non-orbiting scroll member 64 is also provided having a wrap 66 positioned in meshing engagement with wrap 56 of scroll 54. Non-orbiting scroll 64 has a centrally disposed discharge passage 75 which communicates with an upwardly open recess 77 which in turn is in fluid communication with a discharge muffler chamber 79 defined by cap 14 and partition 22. An annular recess 81 is also formed in non-orbiting scroll 64 within which is disposed a seal assembly 83. Recesses 77 and 81 and seal assembly 83 cooperate to define axial pressure biasing chambers which receive pressurized fluid being compressed by wraps 56 and 66 so as to exert an axial biasing force on non-orbiting scroll member 64 to thereby urge the tips of respective wraps 56, 66 into sealing engagement with the opposed end plate surfaces. Seal assembly 83 is preferably of the type described in greater detail in assignee's copending application Ser. No. 591,454, filed of even data herewith and entitled "Scroll Machine With Floating Seal", the disclosure of which is hereby incorporated by reference. Scroll member 64 is designed to be mounted to bearing housing 24 in a suitable manner such as disclosed in the aforementioned U.S. Pat. No. 4,877,382 or as disclosed in assignee's copending application Ser. No. 591,444 filed of even data herewith and entitled "Non-Orbiting Scroll Mounting Arrangement For Scroll Machine", the disclosure of which is hereby incorporated by reference.

An improved counterweight shield 84 is also provided being mounted on drive shaft 30. As best seen with reference to FIGS. 2 through 5, counterweight shield 84 includes a generally circular flange portion 86 extending radially outwardly from adjacent an upper end of a generally cylindrically shaped axially elongated main body 88. Main body 88 has a bore 89 extending axially therethrough through which shaft 30 extends. The lower portion of main body 88 is separated by a plurality of axially extending slots 90 into a plurality of alternating equally spaced segments 92 and 94, segments 92 having a circumferential width substantially greater than the width of segments 94. A reinforcement flange 96 extends generally radially outwardly from each of segments 92 to flange 86 and serves to aid in supporting and rigidifying both flange portion 86 and segments 92. Each of the segments 94 includes a relatively short flange portion 98 at the lower end thereof projecting radially inwardly into bore 89. Flange portions 98 are designed to be received within an annular slot or groove 100 provided on drive shaft 30 between rotor 46 and lower bearing housing 26 so as to axially support and position shield 84 thereon.

Preferably shield 84 will be fabricated as a one piece assembly from a suitable polymeric composition such as by injection molding or the like. Alternatively, however, any other suitable material may be used although it is believed preferable that any such other material have a relatively high dielectric strength due to the proximity of the energized motor windings. As shown, bore 89 will be sized so as to provide a slight clearance with shaft 30 and in like manner flange portions 98 will be sized so as to loosely fit within annular groove 100. Because of the resiliency of segments 94, counterweight shield may be easily assembled to crankshaft 30 by merely sliding it onto shaft 30 from the lower end and allowing flange portions 98 to snap into groove 100 to thereby retain it in position. Preferably, groove 100 will be positioned so as to place flange portion 86 of counterweight shield 84 in close proximity to but spaced from the lower end of rotor 46 and associated counterweight 50. Additionally, the radius of flange portion 86 will preferably be sufficient to enable it to extend beyond the outer edge of counterweight 50 and/or rotor 46 but yet still be spaced from the lower end turns 44 of stator 28. It should also be noted that the axial length of main body 88 will be sufficient so as to provide adequate support to flange portion 86 so as to prevent tipping or wobbling motion thereof.

In operation, rotation of crankshaft 30, rotor 46 and associated counterweight 50 will operate to cause oil within the area between counterweight shield 84 and rotor 46 to be initially thrown radially outwardly across stator windings 44 thereby partially reducing the oil level within this area. As shield 84 is free to rotate with shaft 30, its movement will also assist in partially evacuating this area, however, it should be noted that shield 84 will rotate at a substantially slower speed than shaft 30 due to the viscous drag of the oil therebelow and its loose fit on shaft 30. As the oil is thrown outwardly across stator windings 44, the head pressure of the oil within sump 43 will cause oil to circulate upwardly around the outer edges of shield 84 which oil will then in turn be driven radially outwardly across end turns 44. In this manner a generally continuous flow of oil will be circulated across the end turns 44 thereby enhancing the cooling of same. However, because flange 86 of shield 84 serves to restrict the flow of oil into the area within which the lower end of rotor 46 and associated counterweight 50 are spinning, the viscous drag resulting therefrom is greatly reduced. In actual operation, it has been found that the use of counterweight shield 84 results in substantially greater cooling of stator end turns 44 without any appreciable decrease in overall compressor efficiency as compared to the use of the counterweight shield disclosed in the aforementioned U.S. Pat. No. 4,895,496. It should also be noted that while counterweight shield 84 has been disclosed for use in connection with a scroll-type refrigeration compressor, it is equally well suited for use in other types of compressors.

While it will be apparent that the preferred embodiment of the invention disclosed is well calculated to provide the advantages and features above stated, it will be appreciated that the invention is susceptible to modification, variation and change without departing from the proper scope or fair meaning of the subjoined claims.

I claim:

1. A scroll-type refrigeration compressor comprising:

an outer shell;

compressor means disposed in an upper portion of said shell, said compressor means including first and second interleaved scroll members supported for relative orbital movement therebetween so as to define moving fluid pockets of changing volume;

motor means disposed within said shell below said compressor means and including a stator having end turns and a rotor;

a lubricant sump containing a supply of lubricant disposed in the lower portion of said shell;

a drive shaft drivingly connected to said compressor means and having a lower end extending into said sump, said rotor being secured to said drive shaft and operative to rotatably drive same, said rotor having a lower end portion extending below the normal non-operating upper level of said lubricant and said drive shaft having an annular groove positioned below said rotor; and shield means positioned closely adjacent and in underlying relationship to said rotor, said shield means including integrally formed resilient radially outwardly deflectable means operative to facilitate assembly of said shield means to said shaft and thereafter cooperating with said annular groove in said shaft to support said shield means on said shaft, said rotor being operative to expel lubricant from said area between said shield and said rotor during rotation thereof and said shield being operative to restrict return flow of oil into said area whereby power consumption of said motor is reduced.

2. A refrigeration compressor as claimed in claim 1 wherein said rotor includes a counterweight disposed within said sump, said counterweight rotating with said rotor and aiding in expelling lubricant from said area.

3. A refrigeration compressor comprising:

an outer shell;

a sump disposed in the bottom of said shell containing a supply of lubricant;

a compressor within said shell;

a motor disposed within said shell for driving said compressor, said motor including a stator having end turns and a rotor secured to a shaft drivingly connected to said compressor, the lower end of said rotor being rotatable and extending below the normal upper non-operating level of said lubricant in said sump, said shaft extending downwardly from the lower end of said rotor;

said shaft including an annular groove formed thereon positioned below said rotor; and shield means supported on said shaft, said shield means including an axially elongated cylindrical body portion;

a flange portion extending generally radially outwardly from said body portion intermediate the ends thereof;

means defining a plurality of circumferentially spaced axially extending resilient fingers on said body portion, each of said fingers including a radially inwardly extending flange portion, said radial flange portions being received within said annular groove provided on said drive shaft to thereby retain said shield means in position thereon;

said shield means being operative to restrict oil flow to the rotating lower end of said rotor and to promote circulation of oil across said end turns for cooling same.

4. A refrigeration compressor as claimed in claim 3 further comprising a plurality of axially extending segments interposed between said fingers, said segments being operative to aid said body portion in supporting said flange portion in a generally radial plane.

5. A refrigeration compressor as claimed in claim 4 further comprising supporting flange portions extending between said radial flange and said segments, said supporting flange portions being operative to rigidify said radial flange portion and said segments.

6. A refrigeration compressor as claimed in claim 5 wherein said means defining said fingers and said segments comprise a plurality of circumferentially spaced axially extending grooves on said body portion.

7. A refrigeration compressor as claimed in claim 6 wherein said grooves extend axially from said flange portion to the lower end of said body portion.

8. A refrigeration compressor as claimed in claim 3 wherein said flange portion is positioned intermediate the ends of said body portion.

9. A refrigeration compressor as claimed in claim 3 wherein said annular groove is positioned on said shaft at a location so as to support said flange portion in a relatively closely axially spaced relationship to the lower end of said rotor.

10. A scroll-type refrigeration compressor comprising:

an outer shell;

compressor means disposed in an upper portion of said shell, said compressor means including first and second interleaved scroll members supported for relative orbital movement therebetween so as to define moving fluid pockets of changing volume;

motor means disposed within said shell below said compressor means and including a stator having end turns and a rotor;

a lubricant sump containing a supply of lubricant disposed in the lower portion of said shell;

a drive shaft drivingly connected to said compressor means and having a lower end extending into said sump, said rotor being secured to said drive shaft and operative to rotatably drive same, said rotor having a lower end portion extending below the normal non-operating upper level of said lubricant and said drive shaft having an annular groove positioned below said rotor; and shield means positioned closely adjacent and in underlying relationship to said rotor, said shield means including integrally formed resilient mounting means comprising a plurality of axially elongated fingers, said fingers including a portion resiliently radially outwardly deflectable to enable said shield to be assembled to said shaft and thereafter being receivable within said groove to axially support said shield means said rotor being operative to expel lubricant from said area between said shield and said rotor during rotation thereof and said shield being operative to restrict return flow of oil into said area whereby power consumption of said motor is reduced.

11. A refrigeration compressor as claimed in claim 10 wherein said shield means includes a cylindrical body portion cooperating with said shaft to radially support same.

12. A refrigeration compressor as claimed in claim 11 wherein said body portion includes axially extending segments interposed between said fingers.

13. A refrigeration compressor as claimed in claim 12 wherein said shield means includes an annular flange portion extending radially outwardly from said body portion, the outer periphery of said flange portion being positioned in closely spaced proximity to said end turns to thereby direct oil circulation across said end turns for cooling same.

14. A refrigeration compressor as claimed in claim 13 further comprising reinforcing flanges extending between said radial flange and said body portion.

15. A refrigeration compressor as claimed in claim 14 wherein said shield means is integrally formed from a polymeric composition.

* * * * *